US005695192A

United States Patent [19]

Brown

[11] Patent Number: 5,695,192

[45] Date of Patent: Dec. 9, 1997

[54] CRAPS QUALIFIED BY BLACKJACK

[75] Inventor: J. Breck Brown, Las Vegas, Nev.

[73] Assignee: Steven R. Pyykkonen, Leonard, Mich.

[21] Appl. No.: 719,020

[22] Filed: Sep. 24, 1996

Related U.S. Application Data

[63] Continuation-in-part of Ser. No. 533,567, Sep. 25, 1995, abandoned.

[51] Int. Cl.[6] ..... A63F 1/00

[52] U.S. Cl. ..... 273/274; 273/292

[58] Field of Search ..... 273/274, 292, 273/243, 148 R, 309

[56] References Cited

U.S. PATENT DOCUMENTS

| | | |
|---|---|---|
| 4,443,012 | 4/1984 | Makovic et al. . |
| 4,515,369 | 5/1985 | Johnson . |
| 4,746,126 | 5/1988 | Angileri . |
| 4,887,819 | 12/1989 | Walker . |
| 5,395,120 | 3/1995 | Malek . |
| 5,407,208 | 4/1995 | Keller et al. . |
| 5,413,351 | 5/1995 | Franklin . |

*Primary Examiner*—William M. Pierce
*Attorney, Agent, or Firm*—Howard & Howard

[57] ABSTRACT

A method and game board are disclosed for combining the play of a card game, such as twenty-one, based upon at least one card deck having fifty-two cards divided into four suites of duces through aces and the play of craps based upon two dice each having six faces numbered one to six. The board presents a semi-circular playing arena with a dealer playing area adjacent the straight diameter of the semicircular playing arena and a plurality of player areas spaced about the circumference of the circular periphery of said semi-circular playing arena and opposed to the dealer playing area. Each of the player areas comprises a rectangular card box and a plurality of craps wager indicator circles dividing the numbers 2 through 12 into a plurality of groups for wagering at different odds for each group. After the wagers based upon the cards are settled, each player who has beaten the dealer with a blackjack is offered the roll of the dice and a craps wager on one of the craps wager circles. Before rolling the dice, the remaining players may also place bets on one of their respective craps wager circles. Each craps wager is then settled based the outcome of the roll of the dice. Other card games may come within the scope of this invention.

9 Claims, 1 Drawing Sheet

CRAPS QUALIFIED BY BLACKJACK

This application is a continuation-in-part of Ser. No. 08/533,567, filed Aug. 25, 1995, now abandoned.

TECHNICAL FIELD

The subject invention relates to a combination card and dice game.

BACKGROUND ART

Various games are known in the prior art which combine standard playing cards and two dice. The U.S. Pat. No. 4,746,126 to Angileri discloses a game utilizing the attributes of craps with the play of cards wherein the play of the cards is dependent upon the throw of the dice. The U.S. Pat. No. 4,515,369 discloses a game combining the elements of craps and blackjack wherein the rules of blackjack apply to movement of game pieces as determined by the roll of the dice.

SUMMARY OF THE INVENTION

A method of combining the play of a card game, such as twenty-one, and craps comprising the steps of presenting at least two cards to each player in accordance with the rules of a card game, offering a wager based upon the roll of two dice to a player having a particular set of cards, rolling the dice, and settling the wager based the outcome of the roll of the dice in accordance with the rules of craps. In one example, the particular set of cards is two cards equalling twenty-one points under the rules of blackjack.

An amusement device for combining the play of a card game, such as twenty-one, and craps comprising a presenter for positioning at least two cards for each player, and a craps wager indicator for each player to indicate the craps wager based upon the roll of two dice by each player having a particular set of cards, such as only two cards equaling twenty-one.

BRIEF DESCRIPTION OF THE DRAWINGS

Other advantages of the present invention will become readily appreciated as the same becomes better understood by reference to the following detailed description when considered in connection with the accompanying drawings wherein FIG. 1 discloses a game board illustrating the subject invention.

DETAILED DESCRIPTION OF PREFERRED EMBODIMENT

Figure 1:
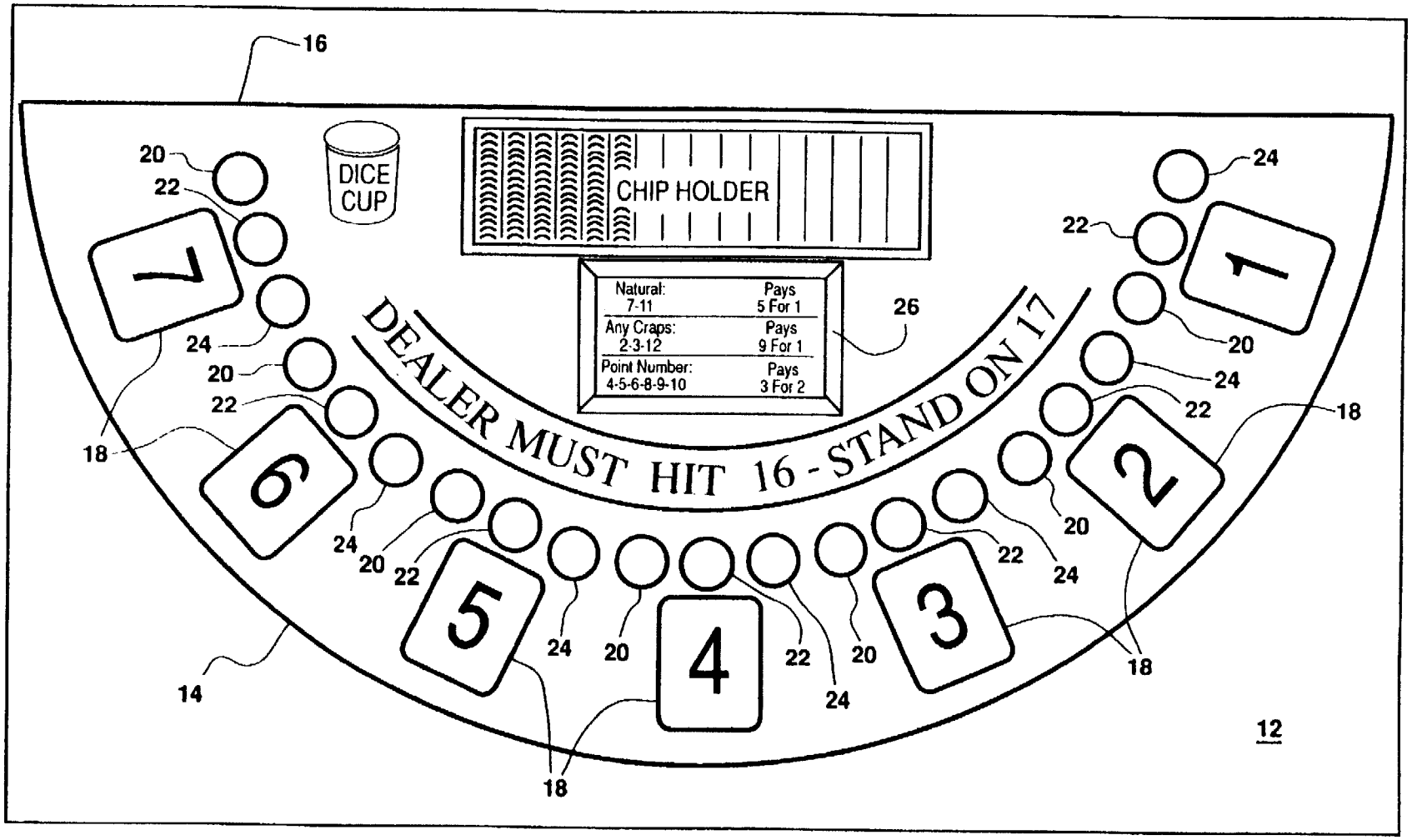

An amusement device for combining the play of a card game, such as twenty-one, and craps is generally shown in FIG. 1. The device takes the form of a mat, table cloth or cover, place mat, or the like, and may even be implemented in a computer program producing images for a monitor. In any case the device comprises a presenter for positioning at least two cards for each player and a craps wager indicator for each player to indicate the craps wager based upon the roll of two dice by each player having only two cards equaling twenty-one.

As illustrated, the device is a game board generally indicated at 10 for combining the play of a card game, such as twenty-one, based upon at least one card deck having fifty-two cards divided into four suites of duces through aces and the play of craps based upon two dice each having six faces numbered one to six. Although the application specifically discloses the use of the card game twenty-one, other card games would come within the scope of this invention. The main thrust is to provide a player the opportunity to play craps, given a particular set of cards. While the specific disclosure relates to the particular set of cards being a blackjack combination, other card games and other particular sets of cards may also be utilized. As an example, the method may also incorporate utilizing a card game such as poker, and providing a player with a flush, or other arrangement of cards, the opportunity to play craps. The board 10 comprises an upper playing surface 12 which presents a semi-circular playing arena, defined by the semi-circle 14 and the straight diameter 16. A dealer playing area is disposed adjacent the straight diameter 16 of the semi-circular playing arena. More specifically, the dealer playing area is in the area indicated by the indicia portraying the chip holder and chips. This is a dealer presentation area for presenting the dealer's cards.

The board also defines a plurality of player areas spaced about the circumference of the circular periphery 14 of the semi-circular playing arena and opposed to the dealer playing area. Each of the player areas comprises a rectangular card box 18 defining a player presentation area for each player to present the player cards. A plurality of craps wager indicator areas 20, 22 and 24 are disposed adjacent each player card rectangle 18 to divide the numbers 2 through 12 into a plurality of groups for wagering at different odds for each group. More specifically, a plurality of three craps wager indicators 20, 22 and 24 are presented for each player with each indicator presenting different odds for different total dice numbers. A first 20 of the indicators, i.e., indicator areas, presents the numerals 7 and 11 for first odds of five for one, a second 22 of the indicator areas presents the numerals 2, 3 and 12 for second odds of nine for one, and a third 24 of the indicator areas presents the remaining numbers for third odds of three for two.

The game board 10 presents an odds area 26 centrally located and indicating the first, second and third odds for the respective wager areas 20, 22 and 24. That is, the table pay-off odds of five chips for one chip bet on a natural 7 or 11, the second table pay-off odds of nine chips for one chip bet on craps 2,3 or 12, and the third table pay-off odds of three chips for one chip bet on the point numbers 4,5,6,8, 9 or 10. The first true odds are three and one half to one for a natural 7 or 11, the second true odds are eight to one for craps 2, 3 or 12, and the third true odds are one to two for point numbers 4, 5, 6, 8, 9 or 10. The board may include other informative indicia like the dealer must take a card when at sixteen in blackjack and stand at seventeen.

The invention, therefore, includes a method of combining the play of twenty-one and craps comprising the basic steps of presenting at least two cards to each player followed by then offering a craps wager based upon the roll of two dice to a player having two cards equaling twenty-one, i.e., to each player having a blackjack. Each player having blackjack and beating the dealer then places a craps wager and rolls the dice; the wagers are then settled based upon the outcome of the roll of the dice. The offering of the craps wager includes the offer of a plurality of alternative dice number combinations in groups having different betting odds. More specifically, the offering of the wager combinations are divided into the dice number combinations of the natural 7 or 11 at first odds, the dice number combinations of any craps 2, 3 or 12 at second odds, and the remaining dice number combinations of the point numbers 4, 5, 6, 8, 9, or 10 at different third odds. For example, the numerals 7 and 11 may be at first odds of five for one, the numerals 2, 3 and 12 may be at second odds of nine for one, and the remaining numbers of 4, 5, 6, 8, 9, and 10 may be at third odds of three for two. Of course, these odds may vary as in accordance with individual house rules.

The play of twenty-one is based upon at least one card deck having fifty-two cards divided into four suites of duces through aces and the play of craps based upon two dice each having six faces numbered one to six. It involves the placing of a blackjack wager on behalf of each player to beat a dealer player by placing chips in front of the card boxes 18. The dealer, or machine, presents two cards to each player including the dealer player by placing the cards on the card boxes 18 in sequence about the semi-circle 14. As is normal in the game of blackjack, additional cards are sequentially presented to each player in response to a request for same from that player. Thereafter, the blackjack wagers are paid or settled in the absence of requests for additional cards. The opportunity or option to roll two dice is then presented to each player beating the dealer player with a blackjack consisting of only two cards equaling twenty-one. However, before the roll of the dice, each player establishes a craps wager, if the player wishes to participate, based upon the roll of the two dice by placing chips on one of the three circles 20, 22, or 24 to indicate the numbers and odds of the roll. The blackjack winner then rolls the dice once and each craps wager is settled based the outcome of the roll of the dice.

Accordingly, at one seating a player may play blackjack and qualify to further bet on a craps roll of the dice each time the dealer or machine is beaten with a blackjack.

The main thrust of this invention is to provide a card player who achieves a particular set of cards the opportunity to play craps. In the specific embodiment, that particular set of cards is blackjack. However, as disclosed above, other sets of cards, such as a flush in poker, or other poker hands, may come within the scope of this invention. Further, card games requiting more or less than 52 cards may also come within the scope of this invention. In addition, while several specific steps for playing the card game are disclosed, it should be understood that games requiring more or less steps also come within the scope of this invention. As an example, it may be that the card game is played electronically. In such a game, more or less steps may be included.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

I claim:

1. The method of combining the play of a card game and craps comprising the steps of:

providing a plurality of playing cards;

presenting at least two cards to each player;

establishing a wager based upon the roll of two dice for a player having a particular set of cards;

providing a pair of dice to roll;

rolling the dice; and settling the wager based upon the outcome of the roll of the dice.

2. A method as set forth in claim 1 wherein the offering of the wager includes the offer of a plurality of alternative dice number combinations in groups having different betting odds.

3. A method as set forth in claim 2 further defined as offering the dice number combinations of 7 or 11 at first odds, and the remaining dice number combinations at different odds.

4. A method as set forth in claim 1, wherein said card game is twenty-one and the particular set of cards is blackjack.

5. A method as set forth in claim 1, wherein the card game utilizes a deck of cards including 52 cards divided into four suites of deuces through aces.

6. A method of combining the play of cards game based upon at least one card deck having fifty-two cards divided into four suites of duces through aces and the play of craps based upon two dice each having six faces numbered one to six, said method comprising the steps of:

at least one card deck having fifty-two cards divided into four suites of duces through aces;

placing a card wager on behalf of each player;

presenting at least two cards to each player including the dealer player;

providing two dice;

presenting the two dice to each player with a blackjack consisting of only two cards equaling twenty-one;

establishing a craps wager for each participating player based upon the roll of the two dice;

rolling the dice;

settling each craps wager based upon the outcome of the roll of the dice;

sequentially presenting additional cards to each player; and paying the wagers in the absence of requests for additional cards.

7. A method as set forth in claim 6 wherein the offering of the craps wager includes the offer of a plurality of alternative dice number combination in groups having different betting odds.

8. A method as set forth in claim 7 further as offering the dice number combinations of 7 or 11 at first odds, and the remaining dice number combination at different odds.

9. A method as set forth in claim 7 further defined as offering the dice number combinations of the natural 7 or 11 at first odds, the dice number combinations of any craps 2, 3 or 12 at second odds, and the remaining dice number combinations of the point numbers 4, 5, 6, 8, 9, or 10 at different odds.

* * * * *